US008980051B2

(12) United States Patent
Nguyen

(10) Patent No.: US 8,980,051 B2
(45) Date of Patent: Mar. 17, 2015

(54) SULFONATION OF PULP PRODUCED BY ALKALI PULPING PROCESS

(75) Inventor: Xuan T. Nguyen, Cincinnati, OH (US)

(73) Assignee: International Paper Company, Memphis, TN (US)

( * ) Notice: Subject to any disclaimer, the term of this patent is extended or adjusted under 35 U.S.C. 154(b) by 246 days.

(21) Appl. No.: 12/429,255

(22) Filed: Apr. 24, 2009

(65) Prior Publication Data

US 2010/0269992 A1 Oct. 28, 2010

(51) Int. Cl.

| | |
|---|---|
| ***D21C 9/14*** | (2006.01) |
| ***D21C 9/10*** | (2006.01) |
| ***D21C 3/02*** | (2006.01) |
| *D21C 9/147* | (2006.01) |

(52) U.S. Cl.

CPC *D21C 3/02* (2013.01); *D21C 9/144* (2013.01); *D21C 9/147* (2013.01)

USPC ..... 162/83; 162/67; 162/82; 162/84

(58) Field of Classification Search

USPC ..... 162/82, 83, 84

See application file for complete search history.

(56) References Cited

U.S. PATENT DOCUMENTS

| | | | |
|---|---|---|---|
| 1,645,061 | A | 10/1927 | Kress |
| 1,651,530 | A | 12/1927 | Kress |
| 1,809,286 | A | 6/1931 | Richter |
| 1,820,502 | A | 8/1931 | Schuber |
| 1,923,292 | A | 8/1933 | Bassett |
| 2,145,062 | A | 1/1939 | Taylor et al. |
| 2,466,633 | A | 4/1949 | Brabender et al. |
| 2,954,312 | A | 9/1960 | Bate |
| 3,725,194 | A | 4/1973 | Smith et al. |
| 4,426,258 | A | 1/1984 | Browning |
| 4,560,437 | A | 12/1985 | Kleppe et al. |
| 4,579,628 | A | 4/1986 | Renard et al. |
| 5,522,967 | A | 6/1996 | Shet |
| 5,534,115 | A | 7/1996 | Hoyos et al. |
| H001690 | H | 11/1997 | Nye |
| 5,766,159 | A | 6/1998 | Martin et al. |
| 5,902,454 | A | 5/1999 | Nelson |
| 6,063,982 | A | 5/2000 | Martin et al. |
| 6,464,832 | B2 | 10/2002 | Engelhardt et al. |

FOREIGN PATENT DOCUMENTS

| | | | |
|---|---|---|---|
| CA | 1206704 | 7/1986 | |
| WO | WO 9605364 A1 * | 2/1996 | ..... D21C 9/10 |

OTHER PUBLICATIONS

Gullichsen editor, Chemical Pulping 6A, 1999, Fapet Oy, chapter 9.*

Grace editor, Pulp and Paper Manufacture: Alkaline Pulping, 1989, The Joint Textbook Committee of the Paper Industry, vol. 5 3rd edition, p. 401.*

SMOOK, Handbook for Pulp and Paper Technologists, 1992, Angus Wilde Publications, 2nd edition, chapter 4.*

Gullichsen editor, Chemical Pulping 6A, 1999, Fapet Oy, p. A512-513 and p. A546-A551.*

Pressure Diffuser, downloaded online from www.andritz.com, downloaded on Oct. 19, 2011.*

Andtbacka et al., ECF and TCF bleaching of isothermally cooked (ITC) pulp,Paperi Ja Puu—Paper and Timber, 1994, vol. 76/No. 9.*

SMOOK, Handbook for Pulp and Paper Technologists, 1992, Angus Wilde Publications, 2nd edition, chapter 11.*

Increased Linerboard Pulp Yield Through Sulfonation, H.E. Worster and M.F. Pudek, MacMillan Bloedel Research Limited, Vancouver, B.C., Canada p. 33-35, 1975.

An Update on the Delignification of Kraft Pulps by Sulfite Treatments, Chapter 8, Shiuli Mahmud and Yuan-Zong Lai, p. 78-84, May 2009, Published by ESRI.

K. Kringstad, J. Olausson, sulphonation of high yield kraft pulp, p. 480-485, 1974.

* cited by examiner

*Primary Examiner* — Anthony Calandra

(74) *Attorney, Agent, or Firm* — John K. Pike; Thomas W. Barnes, III

(57) ABSTRACT

This invention relates to the delignification of lignocellulosic pulp. More particularly, the invention relates to sulfonation and bleaching of the alkali pulping produced by Kraft pulp processes or produced through combination of alkali pulping processes and extended delignification stages.

17 Claims, No Drawings

SULFONATION OF PULP PRODUCED BY ALKALI PULPING PROCESS

FIELD OF THE INVENTION

This invention relates to the delignification of lignocellulosic pulp. More particularly, the invention relates to sulfonation and bleaching of the alkali pulping produced by Kraft pulp processes or produced through combination of alkali pulping processes and extended delignification stages.

BACKGROUND OF THE INVENTION

Wood is composed of two main parts, namely, a fibrous carbohydrate or cellulosic portion and a non-fibrous portion comprising a complex chemical, commonly referred to as lignin.

For use in papermaking processes wood must first be reduced to pulp, which can be defined as wood fibers capable of being slurried or suspended and then deposited as a screen to form a sheet. The methods employed to accomplish this pulping usually involve either physical or chemical treatment of the wood, or perhaps some combination of the two processes, to alter its chemical form and to give desired paper properties.

In chemical pulping, the wood chips are digested with chemical solutions to solubilize a portion of the lignin and the effect its removal of the lignin. The more usual of these digestive procedures are the sulfite, sulfate or Kraft, modified sulfite and soda processes.

Common industrial practices for the production of fully bleached chemical pulp grades entail two major unit operations namely 1) Cooking to transform wood chips into pulp and to dissolve associated lignin content, from more than 20% lignin in wood chips to less than 5% lignin in pulp and 2) Bleaching to substantially remove residual lignin in pulp and to increase the pulp brightness.

It is well known that from identical wood species and cooking to similar residual lignin content, pulps produced with alkali pulping processes such as Kraft are stronger but darker in color and more difficult to bleach than pulps produced under acidic conditions such as those used for acid sulfite pulping process.

Caustic, carbonate, sulfide, sulfite, chemical additives or any of their combination are known to be used for alkali pulping processes. Pulps with lower lignin content and higher brightness can also be produced through combination of alkali pulping and an extended delignification stage using bleaching chemicals such as hydrogen peroxide, oxygen or ozone.

Use of solutions of $SO_2$, $MHSO_3$ and $M_2SO_3$ on wood chips is well known in sulfite pulping industry (Pulp and Paper Manufacture Vol. 4. Sulfite Science & Technology, book published by Canadian Pulp and Paper Association). Sulfonation or use of solution of $SO_2$ or combination of $SO_3$ and $SO_2$ on pulps has also been investigated as means to increase associated paper making properties (K. Kringstad, J. Olausson, Svensk Papperstidning n. 13, P 480-485, 1974) (U.S. Pat. No. 5,522,967). Use of $SO_2$ as an alternative source of acid for pulp washing and trace metal removal has also been proposed in U.S. Pat. No. 3,725,194, and U.S. Pat. No. 4,560,437. However, none of these cited references disclose or teach $SO_2$ as a treatment to remove lignin or to transform the treated lignin (i.e., modified lignin) in a manner that would be receptive to chemical reaction or substitution with bleaching chemical during the bleaching sequence.

SUMMARY OF THE INVENTION

This invention relates to sulfonation and bleaching of pulps produced by alkali pulping processes or produced through combination of alkali pulping processes and extended delignification stages.

Accordingly, one aspect of the present invention relates to a method of making pulp comprising sulfonating an alkali pulp at a pH less than 7 prior to, during, or after at least one bleaching sequence. The bleaching sequence occurs after extended delignification stage. The sulfonating of the alkali pulp is generally followed by a washing stage.

Another aspect of the present invention relates to a sulfonated and/or bleached alkali pulp comprising a composition of cellulose, hemicelluloses wherein the amount of cellulose contained in the pulp is from about 55% to about 75% by dry weight of the pulp and the amount hemicellulose contained in the pulp is from about 25% to about 45% by dry weight of the pulp that also containing less than about 5% lignin.

One further aspect of the present invention relates to a paper or paperboard comprising a sulfonated and bleached alkali pulp wherein the amount of cellulose contained in the pulp is from about 55% to about 75% by dry weight of the pulp and the amount hemicellulose contained in the pulp is from about 25% to about 45% by dry weight of the pulp that also containing less than about 5% lignin.

DETAILED DESCRIPTION OF THE INVENTION

It is advantageous to define several terms before describing the invention. It should be appreciated that the following definitions are used throughout this application.

DEFINITIONS

Where the definition of terms departs from the commonly used meaning of the term, applicant intends to utilize the definitions provides below, unless specifically indicated.

For the purpose of the present invention, the term "Kraft Process" refers to alkaline chemical pulping process using sodium hydroxide (NaOH) and sodium sulfide ($Na_2S$) as the active cooking chemicals. The process is noted for producing the strongest pulps. The Kraft process is also defined as sulfate chemical pulping process. In addition, any equipment used as well as any intermediate or final products derived from the process.

For the purpose of the present invention, the term "Kraft Pulp" refers to wood pulp produced by the Kraft sulfate chemical process using cooking liquor. This liquor is made up primarily of sodium hydroxide (NaOH) and sodium sulfide ($Na_2S$), using basically softwood species of pulpwood, but could be hardwood. Kraft pulp is also known as sulfate pulp.

For the purpose of the present invention, the term "Alkali" refers to Sodium-based chemicals such as those found in sulfate pulping liquors.

For the purpose of the present invention, the term "Alkaline pulping" refers to the process of cooking wood chips with alkaline-based chemicals. Examples of such include, but not limited to, Kraft or soda chemical pulping processes. The term may be applied to other high pH (e.g., 9 to 14) chemical pulping processes such as soda-oxygen or alkaline sulfite or sulfate.

For the purpose of the present invention, the term "Bisulfite process" refers to Sulfite pulping process in which the cooking liquor is in the pH range from 2 to 6 and contains a predominance of bisulfite ion ($HSO_3^-$) with little or no true free $SO_2$. Bases used are magnesium, sodium and ammonium.

For the purpose of the present invention, the term "Acid Pulping" refers to a general term usually denotes the sulfite process. However, the term could apply to any low pH (e.g., 2 to 4) chemical pulping process such as (the experimental) nitric acid pulping.

For the purpose of the present invention, the term "Acid sulfite Process" refers to sulfite pulping process in which the cooking acid contains a high percentage of free sulfur dioxide ($SO_2$) relative to combined $SO_2$ and therefore has a very low pH (e.g., 1 to 2). The base may be calcium, sodium, magnesium or ammonium.

For the purpose of the present invention, the term "Sulfate Process" refers to an alkaline pulp manufacturing process in which the active components of the liquor used in cooking chips in a pressurized vessel are primarily sodium sulfide ($Na_2S$) and sodium hydroxide (NaOH) with sodium sulfate ($Na_2SO4$) and Lime (CaO) being used to replenish these chemical in recovery operations. Sometimes referred to as the Kraft process.

For the purpose of the present invention, the term "Sulfate Pulp" refers to fibrous material used in pulp, paper, and paperboard manufacture, produced by chemically reducing wood chips into their component parts by cooking in a vessel under pressure using an alkaline cooking liquor. This liquor consists primarily of sodium sulfide ($Na_2S$) and sodium hydroxide (NaOH). The term sometimes referred to as the Kraft pulp.

For the purpose of the present invention, the term "Sulfonation" refers to a chemical reaction in which lignin is reacted with sulphonation chemical to form lignin sulfonates. Suitable sulfonating agents for the purposes of this invention includes, but not limited to, solution of sulfur dioxide ($SO_2$) or sulfur trioxide ($SO_3$) or sulfurous acid ($H_2SO_3$), sodium metabisulfite ($Na_2S_2O_5$), bi-sulfite ($MHSO_3$) or sulfite ($M_2SO_3$) where M can be Na, Ca, H, K, Mg or their combination.

For the purpose of the present invention, the term "Delignification" refers to removal of all or part of the lignin from wood or plant material by chemical treatment. Chemical pulping and the initial stages of bleaching are examples of delignification. Examples of the initial stages of bleaching are, for example. C (Chlorination), $D_o$ (initial delignification), $D_1$ (first brightening), and $D_2$ (second brightening).

For the purpose of the present invention, the term "sulfur trioxide ($SO_3$)" refers to toxic gas formed by further oxidation of sulfur dioxide (under certain condition) which forms sulfuric acid ($H_2SO_4$) when dissolved in water. Sulfur trioxide is an undesirable by product when burning sulfur for sulfite cooking liquor preparation. In sulfuric acid plants, a heated catalyst is used to promote oxidation to the trioxide form. Any delignification following pulping would be considered extended delignification including the first stages of a delignification and/or bleaching sequence.

For the purpose of the present invention, the term "Extended Delignification" refers to any modification of the pulping process which allows for greater delignification of the pulp without adverse effects on pulp strength, i.e., produces a lower Kappa number pulp. Examples of commercial extended delignification processes are Modified Continuous Cooking and Rapid Displacement Heating.

For the purpose of the present invention, the term "Delignification Index" refers to measurement of the degree of delignification. A commonly used delignification index is the Kappa number test.

For the purpose of the present invention, the term "Lignosulfonates" refers to compounds formed during sulfite cooking by the reaction of sulfurous acid or bisulfite ion with the lignin in the wood. These compounds are soluble in the cooking liquor.

For the purpose of the present invention, the term "Bleaching" refers to whitening process carried out on pulps by selective chemical removal of residual lignin and other colored materials, and with minimal degradation of the cellulosic constituents. With respect to secondary fibers, bleaching can also have a dye removal function.

For the purpose of the present invention, the term "Bleaching Chemical" refers to a variety of chemical used in the bleaching of wood pulp such as chlorine ($Cl_2$), sodium hypochlorite (NaOCl), calcium hypochlorite [$Ca(OCl)_2$], chlorine dioxide ($ClO_2$), peroxide ($H_2O_2$), sodium chlorite ($NaClO_2$), Oxygen ($O_2$), Ozone ($O_3$) and others.

For the purpose of the present invention, the term "Bleaching Sequence" refers to series of stages, each with specific objectives (e.g., delignification, solubilization, destruction of chromophoric groups), that contribute to an overall whitening effect. Typically the pulp is washed between stages.

For the purpose of the present invention, the term "Kappa Number" refers to modified permanganate test value on pulp which has been corrected to 50% consumption of chemical. Kappa number has the advantage of a linear relationship with lignin content over a wide range. For pulp samples under 70% yield, the percent Klason lignin is approximately equal to the Kappa number times a factor of 0.15.

For the purpose of the present invention, the term "Buffer" refers to chemical solution that resists change in pH when acids or alkalis are added. It could include, but not limited to, NaOH, and $H_2SO_4$.

For the purpose of the present invention, the term "Buffering Action" refers to ability to neutralize acids and bases as they are formed during a chemical reaction and thus resist a change in pH.

For the purpose of the present invention, the term "Oxygen Delignification (O-Stage)" refers to treatment of pulp in alkaline medium with oxygen to degrade and solubilize lignin, typically employed as the first stage of a bleaching sequence or as a bleaching "pre-stage". The process is generally carried out at "medium consistency". Oxygen is added as a gas and magnesium salts are usually employed as an additive to "protect" the cellulose from degradation.

For the purpose of the present invention, the term "Ozonation Stage (Z-Stage)" refers to delignification or bleaching treatment of pulp with ozone, carried out under acidic conditions. The ozonation stage is typically used at the beginning of a bleaching sequence where its delignification efficiency is best and where degradation of cellulose is retarded by the high amount of lignin still present in the pulp.

For the purpose of the present invention, the term "Chlorine-Based Delignification Stage, aka, D-Stage" refers to initial delignifying stage ($D_o$) and/or brightening stages ($D_1$ and $D_2$) in a bleaching sequence in the process of a chorine-based bleaching chemical, used to produce high-brightness pulp. Traditionally, the highest and most stable brightness (especially for the softwood Kraft pulps) is achieved when at least two chlorine dioxide brightening stages are used with an alkaline extraction in between.

For the purpose of the present invention, the term "Alkaline Extraction Stage-(E-Stage)" refers to essential stage in any multistage bleaching sequence; it solubilizes the dark-colored chlorinated and/or oxidized lignin compounds formed in the initial acid delignification stage (e.g., chlorination or chlorine dioxide) and in later stages. When used prior to the final bleaching stage, an F-stage also serves to "activate" the pulp for more effective brightening.

For the purpose of the present invention, the term "Peroxide Extraction Stage-(Ep-Stage)" refers to alkaline extraction stage supplemented with a peroxide.

For the purpose of the present invention, the term "Oxidative Extraction Stage-(Eo-Stage)" refers to alkaline extraction stage supplemented with an oxidizing agent, most commonly oxygen. Peroxide or hypochlorite may also be used as supplemental chemicals to provide a brightening effect and/or to reduce effluent color.

For the purpose of the present invention, the term "Oxidative peroxide Extraction Stage-(Eop-Stage)" refers to alkaline extraction stage supplemented with peroxide and an oxidizing agent.

For the purpose of the present invention, the term "Brightening" refers to 1) any chemical treatment to pulp that increases its brightness. 2) Chemical modification of colored elements in high-yield pulps to render them colorless without removing them, thus retaining the yield advantage of these pulps.

For the purpose of the present invention, the term "Peroxide" may be any peroxide, but specifically may refers to sodium peroxide ($Na_2O_2$) or hydrogen peroxide ($H_2O_2$) which are used to make up bleach liquor for bleaching mechanical-type pulp. Peroxides are used in the bleaching of both high-yield and chemical pulps. When used under relatively mild conditions (35 C to 55 C), peroxide is an effective lignin-preserving bleaching agent, improving the brightness of groundwood and other highly lignified pulps without significant yield loss.

For the purpose of the present invention, the term "Consistency" refers to mass or weight percentage of oven dry fiber in a pulp solution, e.g., pulp and water, or stock (pulp and additives) and water. It is expressed as a percentage of this material in the solution, in terms of bone dry (BD), oven dry (OD), or air dry (AD) weight. Consistency is often described qualitatively as low, medium, or high without reference to a standard nomenclature. The following ranges are given as a general guide: very low consistency (0-1%), low consistency (1-8%), medium consistency (8-16%), and high consistency (16-40%).

For the purpose of the present invention, the term "retention time" refers to contact period of pulp with a bleaching chemical; usually measured from the point of chemical addition to the point where residual chemical is washed out or displaced by another chemical.

It has now been discovered that unbleached or partially bleached alkali pulp including, but not limited to, alkali pulp can be treated with a solution containing a sulfonating agent to form sulfonated alkali pulp. When sulfonating unbleached Kraft pulp, it is the lignin portion of the pulp that is sulfonated rather than sulfonation of the cellulose portion. The sulfonating agents may be any agent that, when added to the alkali pulp may sulfonate the lignin. Sulfonation of lignin serves to soften the lignin and/or make it soluble under suitable conditions in the form of sulfonated lignin or a ligno-sulfonate. The sulfonated lignin is extracted easier from the alkali pulp and much receptive to react with bleaching chemicals and therefore the amount of bleaching chemicals used in the bleaching process is significantly reduced. It goes without saying that optionally buffering agent can be used.

The D* stage is conducted in an acidic or almost neutral condition and the process of the present invention provides one or more advantages over prior bleaching processes known in the art. For example, some of the advantages of the embodiments of the process of this invention include 1) significant reduction of bleaching chemicals such as, $ClO_2$, $H_2O_2$, $O_2$, $O_3$, and Z or any combination of the foregoing, 2) reducing the bleaching cost, 3) relatively low capital requirement, 4) high pulp brightness and brightness stability, 5) higher pulp viscosity, 6) improved bleached plant performance and stability, 7) reduction in filtrate Adsorbable Organic Halides (AOX) or 8) a combination of two or more of the aforementioned advantages. Some embodiments of this invention may exhibit one of the aforementioned advantages while other preferred embodiments may exhibit two or more of the foregoing advantages in any combination.

The present invention relates to a novel sulfonation step (D*) that occur after alkaline pulping and anytime before, during or after extended delignification or bleaching sequences. The alkaline pulp of the present invention is preferably Kraft pulp.

One chemical reaction taking place in carrying out the present invention with D* stage is as follows:

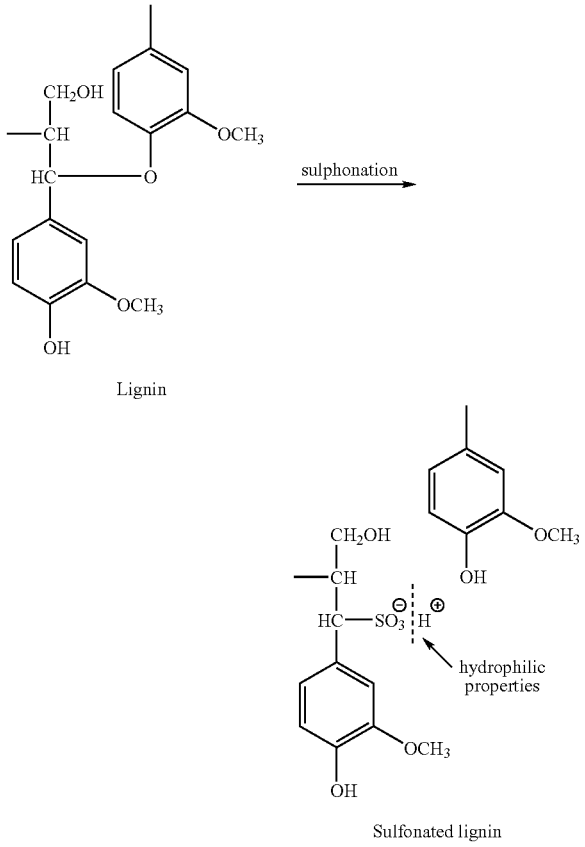

With regards to the sulfonation reaction, there are varieties of ways in which the lignin chain unit can be sulfonated. The sulfonating agents may be any agent that, when added to the Kraft pulp may sulfonate the lignin according to the above chemical reaction. The sulfonation of lignin results in more efficient bleaching process of the alkaline pulp, including Kraft pulp. As an example, treatment of the alkaline pulp with sulfonate before or during an extended delignification and/or bleaching sequence exhibits a similar ISO brightness at much reduced bleaching chemical when compared to the same alkaline pulp without going through the use of sulfonation step disclosed in the present invention.

The temperature of the sulfonation reaction can be from about 70° C. to about 140° C., more preferably from about 80° C. to about 120° C., and most preferably from about 90° C. to about 100° C. At temperatures below 70° C., the reaction proceeds too slowly to be practical. At temperatures greater than 130° C., the lignin's color turns too dark which has adverse effect on the downstream bleaching process.

The pH of the sulfonation reaction can be from about 1 to about less than 7, more preferably from about 2 to about 5, and most preferably from about 2 to about 4.

The consistency (CSC) of the pulp in the D* stage may vary widely and any consistency that provides the desired increase in pulp brightness may be used. The pulp may be bleached under low consistency conditions (i.e. from about 1% to about 5% based on the total weight of the mixture of pulp and bleaching chemicals), medium consistency conditions (i.e. from about 6% to about 15% based on the total weight of the mixture of pulp and bleaching chemicals) or high consistency conditions (i.e. from about 16% to about 30% based on the total weight of the mixture of pulp and bleaching chemicals). The consistency is preferably from about 10% to about 14%.

The retention times in the D* stage is defined as the contact time between $SO_2$ and the lignin in the pulp. The retention time in the D* stage will vary widely. Usually, retention times will be at least about 30 minutes. Retention times are preferably from about 30 min. to about 300 min., and are more preferably from about 60 minutes to about 240 min., and are most preferably from about 60 min. to about 120 min.

With regard to the sulfonation reaction, suitable sulfonation reagents include, without limitation, alkali bisulfite, such as sodium bisulfite, and a combination of sodium hydroxide and sulfur dioxide. A preferred reagent is sodium bisulfite ($NaHSO_3$) or alternatively, sulfur dioxide ($SO_2$), or sulfur trioxide ($SO_3$) or sulfurous acid ($H_2SO_3$), bi-sulfite ($MHSO_3$) or sulfite ($M_2SO_3$) where M can be Na, Ca, H, K, Mg or their combinations. The concentration of sodium bisulfite is not critical provided there is an excess over the stoichiometric amount required to proceed with the reaction.

A preferred method of making sulfonated alkaline pulp is to sulfonate the alkaline pulp such as Kraft pulp with at least about 0.5% sulfur dioxide at a consistency from about 10% to 20% for over two hours at about 90° C. or above. The alkaline pulp thus produced is then preferably washed with the water to remove residual chemicals such as sulfate and the dissolved lignin. The sulfonated alkaline pulp is then transferred to one of the bleaching stages such as $D_0$, Eop, $D_1$ and so on.

In one embodiment of this invention, the D* stage can be with or without an optional washing stage at any stage in the bleaching process provided that D* stage pulp is an alkaline pulp. In general, the D* stage may occur after alkaline pulping process and at prior to any delignification or bleaching stage such as those utilized within the extended delignification stage. Thereafter, the sulfonated alkaline pulp can be washed immediately following the D* stage or at any subsequent point prior to or after a subsequent $D_o$ delignification stage or for example, prior to the Eop or Ep stage. The D* stage can also occur after earlier delignification stages as for example an oxygen delignification stage and/or a $D_o$ delignification stage followed by a subsequent interstage washing prior to the Eop or Ep stage. The D* stage with interstage washing can be immediately preceding the Eop or Ep stage, or can be separated from these stages by one or more other stages.

In another embodiment, after D* stage, the alkaline pulp is preferably washed in the process prior to $D_o$ stage. Pulp washing after the D* stage removes the sulfur dioxide residuals and some residual metals to protect peroxide used in the subsequent Ep or Eop stage. In the preferred embodiment of the invention all or substantially all of the sulfur dioxide residuals are removed by washing after the D* stage.

After the washing stage, the alkaline pulp may be subjected to $D_o$ delignification stage. The delignification of unbleached pulp is achieved through a sequence of further steps including delignification steps, bleaching steps, and/or extraction steps. Conventional processes and apparatus can be used in the $D_o$ delignification stage. See for example "Pulp Bleaching Principles and Practice of Pulp Bleaching" Carlton W. Dence and Douglas W. Reeve, TAPPI Press, 1996 and references cited therein.'

Alternatively, after the washing stage, the alkaline pulp may be subjected to Oxygen delignification stage. Oxygen and steam may be added directly to the reactor. The sulfonated alkaline pulping fall through the reactor to be diluted and discharged at the bottom. The pulp then passes through several stages of washing before proceeding to the chlorination or chlorine dioxide stage in a multi-stage bleaching process where chlorine dioxide solution is mixed with pulp and allows reacting, and then washed as one of the operations making up a complete pulp bleaching system. The organic material dissolved in delignification is ultimately burned in the recovery boiler. Conventional processes and apparatus can be used in the O delignification stage. See for example "Pulp and Paper Manufacture—Vol. 5, Alkaline Pulping" Technical Editors: T. M. Grace and E. W. Malcolm and references cited therein.

One of the advantages of the D* stage, is the reduction of bleaching chemicals during extended delignification or bleaching sequences as compared to the same or substantially the same extended delignification or bleaching which do not include the D* stage. For example, the reduction in the amount of bleaching chemical such as chlorine dioxide ($ClO_2$) is preferably at least about 20%, more preferably at least about 30%, and most preferably up to 40% less than the amount of $ClO_2$. Moreover, caustics and peroxides are reduced as well.

The Inventor has discovered that in the $D_o$ stage, the brightness of pulp is higher or at least the same than those treatments without D* stage, which indicates the positive impact of D* treatment on the bleaching chemical efficiency and selectivity in the $D_o$ stage. For example, the brightness is at least about 1%, preferably at least about 2%, more preferably from about 3% to about 5% and most preferably from about 6% to about 7% greater than the brightness of the pulp made by the same or substantially the same bleaching processes which do not include the D* stage.

In one embodiment of this invention, a delignification is used after D* stage and followed by an extraction stages such as E or Eop. Conventional process parameters employed in these oxidative extraction stage can be described in, for example "Pulp Bleaching Principles and Practice of Pulp Bleaching" Carlton W. Dence and Douglas W. Reeve, TAPPI Press, 1996 and references cited therein. Accordingly, they will not be described in greater detail.

In addition to the D* stage followed by an optional washing stage prior to the $D_o$ stage or (i.e., $D^*D_o$). Other bleaching sequences such as $D_o$ D* or D*Eop or D*Ep or $D_o$ D*Eop or $D_o$ D*Ep are preferred embodiment of the invention. Bleaching process of this invention may include other delignification or bleaching stages as for example bleaching with $Cl_2$, peroxy acids, chlorine dioxide, ozone and the like, and extraction stages such as extraction with oxygen, ozone, borohydride, chlorine dioxide and the like. Illustrative of such full extended delignification or bleaching processes as the present invention include are D*(D/C)Eop, ($D_oD^*$)EopD, D*$D_o$EopD, (D*$D_o$)EopED, (D*$D_o$)EDEpEopD, D*Z(E)D, D*Z(Eop)P, D*$D_o$EpZ(Eop), D*$D_o$EpZD(ZD), D*$D_o$(Eop)D(ZD), D*$D_o$(Eop)PP, D*$D_o$(Eop)DZ, D*$D_o$EopD$_1$, OD*$D_o$EopD$_1$, D*$D_o$EopD$_1$D$_2$, OD*$D_o$EopD$_1$D$_2$, D*$D_o$EopD$_1$EpD$_2$, OD*$D_o$EopD$_1$EpD$_2$, D*$D_o$EopD$_1$P and the like in which D is as described above and Z is ozone, E is extraction in the presence of base, O is oxygen, P is peroxide, D/C is a mixture of chlorine dioxide and elemental chlorine and two or more symbols in parenthesis indicate an absence of an intermediate washing stage. The Eop, Ep, and $D_o$ are defined herein above. The processes and apparatus used in the D, Z, E, O, P, and D/C are conventional and there are well known in art. See for example, "Pulp Bleaching Principles and Practice of Pulp Bleaching" Carlton W. Dence and Douglas W. Reeve, TAPPI Press, 1996 and references cited therein.

The sulfonated alkali pulp of the present invention after the D* stage, whether hardwood or softwood pulp, comprises any amounts of cellulose, hemicelluloses, and lignin. These pulps may have any amounts of cellulose and hemicelluloses including, but not limited to, from 55-75 wt % cellulose and from 25-45 wt % hemicelluloses. These pulps may also include any amounts of lignin including, but not limited to, less than about 1, 2, 3, 4, and 5 wt % lignin. After the D* stage, these pulp may contain any amount of sulfonated lignin including, but not limited to, from about 1 wt % to about 100 wt % sulfonated lignin based upon total amount of lignin present in the pulp. Examples include 1, 2, 5, 10, 15, 20, 25, 30, 35, 40, 45, 50, 55, 60, 65, 70, 75, 80, 95, and about 100 wt % sulfonated lignin based upon the total lignin present in the pulp, including any and all sub ranges therein. Furthermore, in one example, softwood (SW) species pulp comprises about 45% cellulose, about 25% hemicelluloses, about 25% lignin, and about 2-5% extractives. In another example, hardwood (HW) species pulp comprises about 45% cellulose, about 31% hemicelluloses, 21% lignin, and about 2-5% extractives. The inventor of the present invention has discovered that by implementing the D* stage in a bleaching sequence, the lignin for the HW pulp is significantly impacted and preferably reduced. For example, Kappa number for the HW pulp can be reduced as much as 40 to 50%.

Kappa Number of the sulfonated HW Kraft pulp can vary widely. The Kappa number is preferable form about 4 to about 10 and is more preferably from about 6 to about 8.

The plant source of pulp for use in this invention is not critical and may be any fibrous plant which can be subjected to chemical pulp bleaching. Examples of such fibrous plants are trees, including hardwood fibrous trees such as aspen, eucalyptus, maple, birch, walnut, acacia and softwood fibrous trees such as spruce, pine, cedar, including mixtures thereof. In certain embodiments, at least a portion of the pulp fibers may be provided from non-woody herbaceous plants including, but not limited to, kenaf, hemp, jute, flax, sisal, or abaca although legal restrictions and other considerations may make the utilization of hemp and other fiber sources impractical or impossible. The source of pulp for use in the practice of this invention is preferably hardwood and softwood fibrous trees, more preferably Eucalyptus, Spruce and Aspen and is most preferably Aspen and Spruce.

The pulp used in the process of this invention can be obtained by subjecting the fibrous plant to alkaline pulping process. Following the wood digestion process, pulp is separated from the spent pulping liquor. The spent pulping liquor is then recovered and regenerated for recycling. The pulp is then bleached and purified in a bleach plant operation. Such operation includes the D* stage of the present invention.

The pulp of this invention can also be used in the manufacture of paper and packaging products such as printing, writing, publication and cover papers and paperboard products. Illustrative of these products and processes for their manufacture are those described in U.S. Pat. Nos. 5,902,454 and 6,464,832 and See for example, "Handbook for Pulp and Paper Technologists" G. A. Smook, 1982.

In another example, the alkaline pulp of this invention may be converted into fluff pulp as well as absorbent articles such as diapers, tissues, towels, personal hygiene products, and automotive filters using conventional processes. Such products and their methods of manufacture are known to those of skill in the art and will not be described in detail. See for example, U.S. Pat. Nos. 6,063,982 and 5,766,159 and references described therein. The alkaline pulp of this invention can be used to make saturating alkaline paper. Saturating craft paper is a paper sheet made from unbleached Kraft pulp (mixture of mostly hardwood and some softwood such as southern pine) that is used as substrate for impregnation and curing with resin polymers. Saturating alkaline paper is used as home and office building materials, such as kitchen counter tops.

The present invention is described in more detail by referring to the following examples and comparative examples which are intended to more practically illustrate the invention and not to be a limitation thereon.

Example 1

An unbleached hardwood pulp sample, collected from a commercial southern US mill was analyzed and found to have a kappa of 15.5. This unbleached pulp sample was first digested with a water solution containing sulfur dioxide ($SO_2$), at 11% consistency, for a period of 2 hours at 90° C. After washing with fresh water and washed water removed, the $SO_2$ pretreated pulp was bleached with bleaching chemicals such as chlorine dioxide ($ClO_2$), caustic (NaOH) and hydrogen peroxide ($H_2O_2$) and in a three stage DEpD bleaching sequence. The pulp bleaching in the first D stage was carried out at 5% pulp consistency, for 50 minutes at 65° C. After pulp washing, washed D pulp was bleached in Ep stage at 11% consistency, for 50 minutes at 85° C. Washed Ep pulp was bleached in the final D stage at 11% consistency, for 3 hours at 70° C. The final bleached pulp was measured for brightness. Using a $ClO_2$ dosage of 14 lbs/bdt in the first D stage, 10 #/bdt of hydrogen peroxide ($H_2O_2$) and 24 #/bdt of NaOH in Ep stage and 8 #/bdt of ClO2 and 3 #/bdt of NaOH in final D stage, the final bleached pulp has a brightness of 88 ISO. The total ClO2 requirement was 22 #/bdt and total NaOH requirement was 27 #/bdt. The pH in the D* stage was from about 2.5 to about 3.5.

Comparative Example 1

Without going through the SO2 digestion stage, the unbleached pulp sample used in Example 1 was bleached with ClO2, NaOH and H2O2 in a three stage DEpD bleaching sequence. First D stage, Ep stage and final D stage were operated at consistency, time and temperature identical to those used for D, Ep,D stage of Example 1. Using a ClO2 dosage of 20 #/bdt in first D stage, 20 #/bdt of H2O2 and 26 #/bdt of NaOH in Ep stage and 18 #/bdt of ClO2 and 10 #/bdt of NaOH in final D stage, the final bleached pulp has a brightness of 88 ISO. The total ClO2 requirement was 38 #/bdt and total NaOH usage was 36 #/bdt.

Comparing results of Example 1 with results of Comparative Example 1 showed that with SO2 pretreatment, DEpD bleaching of southern hardwood to identical 88 ISO brightness can be carried out at much reduced chemical requirement namely total $ClO_2$ requirement reduced from 38 #/bdt to 22 #/bdt, total NaOH requirement reduced from 36 #/bdt to 27 #/bdt and total H2O2 requirement reduced from 20 #/bdt to 10 #/bdt.

Example 2

An unbleached softwood pulp of pine wood species collected from a southern US mill was analyzed and found to have a kappa of 28.5. This unbleached pulp sample was first digested with a water solution containing sulfur dioxide (SO2), at 11% consistency, for a period of 2 hours at 90° C. After washing with fresh water and wash water removed, the SO2 pretreated pulp was bleached with bleaching chemicals such as chlorine dioxide (ClO2), caustic (NaOH) and hydrogen peroxide (H2O2) and in a three stage DEpD bleaching sequence. The pulp bleaching in the first D stage was carried out at 5% pulp consistency, for 50 minutes at 65° C. After pulp washing, washed D pulp was bleached in Ep stage at 11% consistency, for 60 minutes at 80° C. Washed Ep pulp was bleached in the final D stage at 11% consistency, for 2 hours at 75° C. After washing the final D stage pulp was analyzed for brightness. Using a ClO2 dosage of 40 lbs/bdt in the first D stage, 10 #/bdt of hydrogen peroxide (H2O2) and 50 #/bdt of NaOH in Ep stage and 14 #/bdt of ClO2 and 3 #/bdt of NaOH in final D stage, the final bleached pulp has a brightness of 90 ISO. The combined ClO2 usage for two D stage was 54 #/bdt and total NaOH usage for all stages was 53 #/bdt. The pH in the D* stage was from about 2.5 to about 3.5.

Example 3

An unbleached softwood pulp of pine wood species collected from a southern US mill was analyzed and found to have a kappa of 28.5. This unbleached pulp sample was first digested with a water solution containing sulfur dioxide (SO2), at 11% consistency, for a period of 2 hours at 90° C. After washing with fresh water and wash water removed, the SO2 pretreated pulp was bleached with bleaching chemicals such as chlorine dioxide (ClO2), caustic (NaOH) and hydrogen peroxide (H2O2) and in a five stage stage DEpDED bleaching sequence. The pulp bleaching in the first D stage was carried out at 5% pulp consistency, for 50 minutes at 65° C. After pulp washing, washed D pulp was bleached in Ep stage at 11% consistency, for 60 minutes at 80° C. Washed Ep pulp was bleached in second D stage at 11% consistency, for 2 hours at 75° C. Washed second D stage pulp was bleached in E stage at 11% consistency, for 45 minutes at 80° C. Washed E pulp was bleached in final D stage at 11% consistency, for 2 hours at 70° C. After washing, the final D stage pulp was analyzed for brightness. Using a ClO2 dosage of 28 lbs/bdt in first D stage, 10 #/bdt of hydrogen peroxide (H2O2) and 36 #/bdt of NaOH in Ep stage, 14 #/bdt of ClO2 in second D stage, 14 #/bdt of NaOH in E stage and 4 #/bdt of ClO2 in final D stage, the final bleached pulp has a brightness of 92 ISO. The combined ClO2 usage for all three D stages was 46 #/bdt and combined NaOH usage for all stages was 50 #/bdt. The pH in the D* stage was from about 2.5 to about 3.5.

Comparative Example 2

Without going through the SO2 digestion stage, the unbleached pulp sample used in Example 2 was bleached with ClO2, NaOH and H2O2 in a five stage DEpDED bleaching sequence. Consistency, time and temperature for individual D, Ep, D, E, D stages were identical those of five DEpDEP stages of Example 3. Using a ClO2 dosage of 56 #/bdt in first D stage, 10 #/bdt of H2O2 and 60 #/bdt of NaOH in Ep stage, 14 #/bdt of ClO2 in second D stage, 14 #/bdt of NaOH in E stage and 4 #/bdt of ClO2 and 1 #/bdt of NaOH in final D stage, the final bleached pulp has a brightness of 90 ISO. The combined ClO2 usage for all three D stages was 74 #/bdt and combined NaOH usage for all stages was 75 #/bdt.

Comparing results of Example 3 with results of Comparative Example 2 showed that when bleached with identical five stages DEpDED bleaching sequence, the pretreatment of unbleached southern pine with SO2 stage resulted in three significant process improvement namely, reducing the total ClO2 usage from 74 #/bdt to 46 #/bdt, reducing total NaOH usage from 75 #/bdt to 50 #/bdt and raising the final pulp brightness from 90 ISO to 92 ISO.

Comparing results of Example 2 with results of Comparative Example 2 showed that to bleach pine softwood to same 90 ISO brightness, the SO2 pretreatment can be used to reduce the requirement of number of bleaching stages, from five stages DEpDED bleaching to three stages DEpD bleaching. In addition to less major process equipment and less electrical power and less steam requirement, it also reduced the total ClO2 requirement from 74 #/bdt to 54 #/bdt.

Various modifications and variations may be devised given the above-described embodiments of the invention. It is intended that all embodiments and modifications and variations thereof be included within the scope of the invention as it is defined in the following claims.

What is claimed is:

1. A method of making a sulfonated and bleached pulp comprising:

subjecting an alkali pulp to a sulfonating and bleaching sequence selected from the group consisting of $D_0D^*$, $D_0D^*Eop$, $D_0D^*Ep$, and $(D_0D^*)EopD$;

wherein D* comprises sulfonating the pulp at a pH less than 7 at a temperature of 70° C. to about 120° C. then washing; and wherein at least one chlorine-based bleaching agent is used in the bleaching sequence;

to produce the sulfonated and bleached pulp.

2. The method of claim 1 wherein the alkali pulp is a Kraft pulp.

3. The method of claim 1 wherein the sequence is $D_0D^*$.

4. The method of claim 1 wherein the sulfonating of the alkali pulp is performed by a sulfonating agent selected from the group consisting of sulfur dioxide ($SO_2$) or sulfur trioxide ($SO_3$) or sulfurous acid ($H_2SO_3$), sodium metabisulfite ($Na_2S_2O_5$), bi-sulfite ($MHSO_3$) or sulfite ($M_2SO_3$) where M can be Na, Ca, H, K, Mg or any combination of two or more thereof.

5. The method of claim 1 wherein the pulp pH is from about 2.0 to about 4.0.

6. The method of claim 1 wherein the pulp consistency in the sulfonating is from about 8% to about 14%.

7. The method of claim 1 wherein the retention time of the pulp in the sulfonating is from about 60 min. to about 120 min.

8. The method of claim 1 wherein the washing removes substantially an entirety of a residual sulfonating agent.

9. The method of claim 1 wherein the sulfonating reduces the amount of the chlorine-based bleaching agent required in the sequence to achieve the brightness of the sulfonated and bleached pulp by 35% compared to the amount required to achieve the brightness in the absence of the sulfonating.

10. The method of claim 1 wherein the sulfonating increases the brightness of the sulfonated and bleached pulp by at least 3 ISO points compared to the brightness in the absence of the sulfonating.

11. The method of claim 1, wherein the chlorine-based bleaching agent is selected from the group consisting of chlorine, sodium hypochlorite, calcium hypochlorite, chlorine dioxide, and sodium chlorite.

12. The method of claim 1, wherein the chlorine-based bleaching agent is chlorine dioxide.

13. The method of claim 1 wherein the sulfonating increases the brightness of the sulfonated and bleached pulp by about 1 to 7% compared to the brightness in the absence of the sulfonating.

14. The method of claim 1, further comprising converting the sulfonated and bleached pulp into one or more selected from the group consisting of paper, printing paper, writing paper, publication paper, cover paper, paperboard, absorbent article, fluff pulp, diaper, tissue, towel, personal hygiene product, automotive filter, saturating alkaline paper, and saturating Kraft paper.

15. The method of claim 1, wherein the sequence is $D_0D^*Ep$.

16. The method of claim 1 wherein the sequence is $(D_0D^*)$ EopD.

17. The method of claim 1 wherein the sequence is $D_0D^*Eop$.

* * * * *